United States Patent [19]

Kawase et al.

[11] 4,313,493

[45] Feb. 2, 1982

[54] FORCED AIR UNIT

[75] Inventors: Akira Kawase; Masao Takouchi; Yoshio Tsuji; Sadao Mitsumeri; Susumu Miyazaki, all of Tokyo, Japan

[73] Assignees: Tokyo Gas Co. Ltd.; Hitachi Seisakusho Co., Ltd., both of Japan

[21] Appl. No.: 112,230

[22] Filed: Jan. 15, 1980

Related U.S. Application Data

[63] Continuation of Ser. No. 729,703, Dec. 13, 1976, abandoned.

[51] Int. Cl.[3] ..... F24H 3/06

[52] U.S. Cl. ..... 165/122; 165/125

[58] Field of Search ..... 165/122–125; 62/426

[56] References Cited

U.S. PATENT DOCUMENTS

| | | | |
|---|---|---|---|
| 2,399,487 | 4/1946 | Hartwig | 165/124 |
| 2,941,382 | 6/1960 | Wuesthoff | 62/426 X |
| 3,366,169 | 1/1968 | Laing | 165/122 |
| 4,146,776 | 3/1979 | Johansen | 165/122 X |

FOREIGN PATENT DOCUMENTS

| | | | |
|---|---|---|---|
| 281700 | 12/1964 | Netherlands | 165/122 |

*Primary Examiner*—Samuel Scott
*Assistant Examiner*—Theophil W. Streule, Jr.
*Attorney, Agent, or Firm*—McGlew and Tuttle

[57] ABSTRACT

A forced air unit comprising a front cover member, a rear cover member connected to and spaced from said front cover member defining a unit housing therebetween having a width and a housing periphery. A heat exchanger is disposed around the entire periphery of the housing with a centrifugal fan rotatably mounted in the housing with an axis extending in the width direction thereof. The fan has a central inlet area and an annular outlet area with a motor mounted in the central inlet area for rotating the fan to draw air axially inwardly toward the inlet area and radially outwardly through the annular outlet area. A fan cover is disposed over the fan within the housing with an inlet opening positioned over the inlet area of the fan. The fan housing has an outlet opening covering a portion of the housing periphery with the remainder of the housing periphery acting as an inlet.

11 Claims, 11 Drawing Figures

FIG. 7
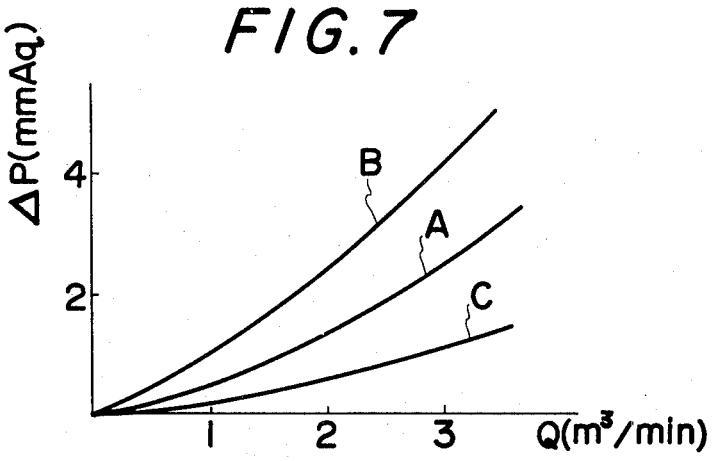
FIG. 8
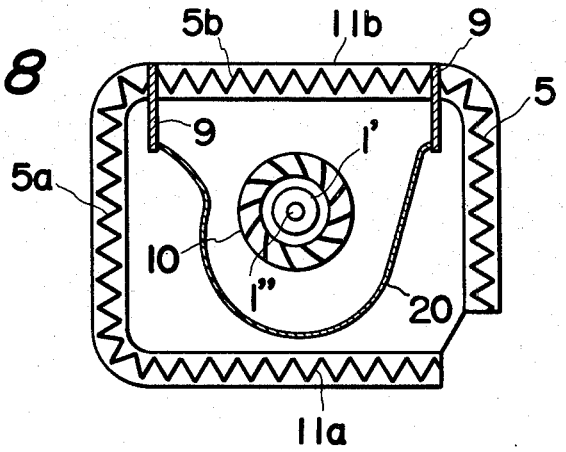
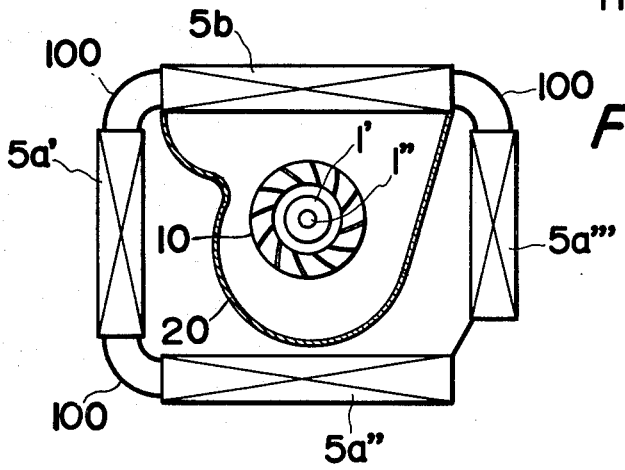
FIG. 9

FORCED AIR UNIT

This is a continuation, of application Ser. No. 729,703 filed Dec. 13, 1976, now abandoned.

BACKGROUND OF THE INVENTION

1. Field of the Invention

The invention relates in general to the construction of radiators or units utilized for heating or cooling rooms, and in particular, to a new and useful radiator of the type which uses a fan for forcefully circulating heated or cooled air.

2. Description of the Prior Art

In the following description, the construction of known radiators, and fan convectors, will be illustrated with reference to the attached drawings.

FIG. 1 shows a fan convector provided with a heat exchanger 3 at the exhaust side of a fan 1. FIG. 3 is a sectional view of FIG. 1.

FIG. 2 is another known fan convector wherein there is provided a heat exchanger 3 at the air intake side of a fan 1. In each of the fan convectors there is shown a heat changer 3 extending in parallel to the axis of rotation of fan 1 in order to widen the area of the air flowing part of heat exchanger. This widened area of air flow for heat exchanger 3 reduces pressure loss. The depth (dimension) of a fan convector housing 4 is necessarily determined by the diameter (dimension) of fan casing 2 for fan 1. It may be difficult, therefore, for a convector utilizing heated water whose volume of radiant heat is 1500 Kcal to 2000 Kcal, to reduce the depth (dimension) of housing 4 to less that 120 mm. Since a fan convector is usually positioned within a room, however, it is desirable that the depth of a fan convector housing be as small as possible, so that the area of a room may be effectively used. In addition, if a fan convector of a thin type fan be adopted, it is convenient for interior decoration.

STATEMENT OF THE OBJECT OF THE INVENTION

An object of the present invention, in view of the above-mentioned problems, is to provide a fan-coil or forced air unit, of thinner construction compared to known constructions.

It is a further object of the invention to provide a new radiator which may generate less from the fan or motor while ventilating in order not to destroy the atmosphere of a room.

It is a still further object of the invention to provide a radiator so constructed as to be available for multiple uses in heating or cooling according to heating or cooling conditions, that is, a radiator or unit which can ventilate forcibly or ventilate not forcibly by means of natural ventilation for heating or cooling.

BRIEF DESCRIPTION OF THE DRAWINGS

In the drawings:

FIG. 7 is a graph showing a comparison of pressure losses of fan convectors embodied in accordance with the invention.

FIG. 8 is a view showing an embodiment of the invention wherein heat exchangers are separated from each other with a parting strip, and wherein the heat exchangers are positioned at the air intake and exhaust side of a fan respectively.

FIG. 9 is a view showing a fan convector embodied in accordance with the invention wherein there is constituted a heat exchanger at each side of a covering square housing with the heat exchanger connected in series.

DETAILED DESCRIPTION OF THE INVENTION

The invention relates to a fan-coil unit for cooling or heating rooms by means of forcible ventilation, and it is characterized by: having a housing whose outer form can be formed so thin that it gives fewer ventilating and operating noises and can be adopted for various uses.

Figure 1:
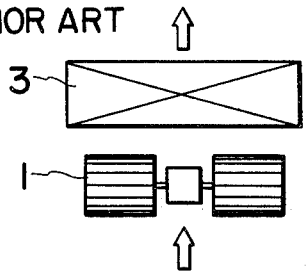
FIG. 1 PRIOR ART
FIG. 1 is a front elevation showing a fan convector with a heat exchanger which is constituted at the exhaust side of a fan.
Figure 2:
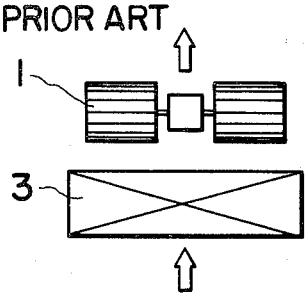
FIG. 2 PRIOR ART
FIG. 2 is a front elevation of a fan convector with a heat exchanger which is constituted at the air intake side of a fan.
Figure 3:
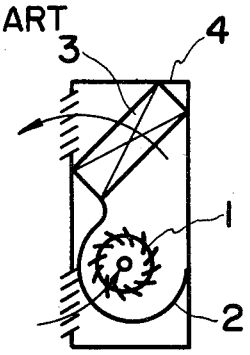
FIG. 3 PRIOR ART
FIG. 3 is a sectional view of the fan convector illustrated in FIG. 1.
Figure 4:
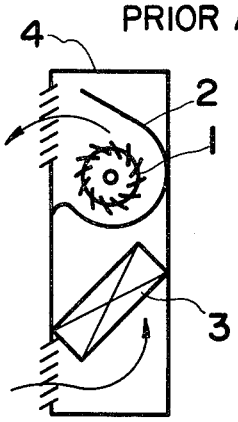
FIG. 4 PRIOR ART
FIG. 4 is a sectional view showing the fan convector illustrated in FIG. 2.
Figure 5:
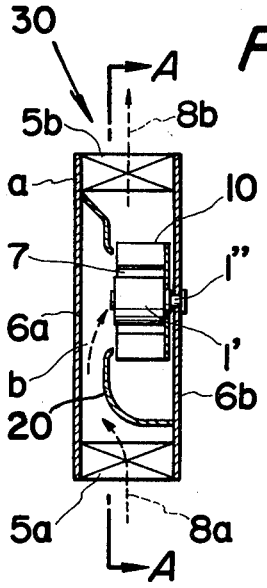
FIG. 5 is a right side view of a longitudinal fan convector constructed in accordance with the invention.

A preferred embodiment of the invention will be described in detail below in accordance with FIG. 5 and FIG. 6.

A sirocco fan 10 is provided inside a relatively thin housing 30 composed of front member **6*a* and rear cover member 6*b*. Sirocco fan 10 has an axis of rotation 1'' extending across the depth (dimension) of housing 30. The fan is secured in the center of rear cover 6*b*. In the impeller or central inlet area of sirocco fan 10 is provided a very thin motor 1. The axis of rotation 1'' of sirocco fan 10 is common to that of motor 1'**. In this specification, a sirocco fan means one which intakes air from the axial direction and discharges it in the radical direction, that is the so-called centrigugal fan.

An air inducing frame or sirocco fan casing 20 is provided over fan 10 and has an inducing inlet opening b. Inlet opening b is positioned over the central inlet area of fan 10. Disposed around the central inlet area of fan 10 is an annular outlet passage or area 7. Fan casing 20 also includes an air oulet opening which covers a portion **11*b* of the housing periphery. The remainder of the housing periphery at 11*a* acts as an inlet so that air is drawn axially inwardly of fan 10 through inlet 11*a* around housing 20 then into inlet opening b, axially inwardly of central inlet area of fan 10 then radially outwardly through an annular outlet area 7 and out of casing 20 through the outlet portion 11*b* of the housing periphery. In the embodiment shown in FIG. 6, the inlet portion 11*a* of the housing periphery comprises approximately two-thirds of the periphery with the outlet portion 11*b* comprising one-third of the periphery. Heat exchanger means 5 have at least one portion 5*a* in the inlet peripheral area 11*a* of the housing and at least one portion 5*b* in the outlet peripheral portion 11*b*** of the housing.

The open part of the outer periphery of housing 30 is, except air inlet port **11*a* made of inducing frame 20, formed into outlet port 11***b* by way of which discharged air from sirocco fan 10 is exhausted to the outside of housing 3.

5*a* is the heat exchanger means portion provided within air inlet port 11*a*. 5*b* is the heat exchanger means portion provided within outlet port 11*b*, and the heat exchangers 5*a* and 5*b* are connected. Hot water sent from a hot water boiler (not shown) is circulated therebetween.

Furthermore heat exchangers 5*a* and 5*b* are of a fin and tube type, and each of them is directly in contact with front covering 6*a* and rear covering 6*b* of covering 30.

Fan casing 20 extends across or intersects the heat exchanger means 5 at two spaced locations thereof dividing out the heat exchanger section 5*b* along the housing periphery occupied by heat exchanger portion 5*b*. The outlet port 11*b* is thus defined by the casing 20 and the rear cover member 6*b* across the periphery of the housing occupied by heat exchanger portion 5*b*.

In another embodiment, however, the heat exchangers 5*a* and 5*b* may be in contact only with front covering 6*a*.

In the embodiment shown in FIG. 8 there is provided a heat exchanger means which has separate exchanges 5*b* and 5*a* which are separated by parting strips 9, 9 which lead to inducing frame 20, and both heat exchangers are connected into the outer periphery of housing 3.

FIG. 9 shows another embodiment wherein there are provided heat exchangers 5*a*', 5*a*'', 5*a*''', each of them is separately constituted, and they are connected in series with each other by connecting tube 100.

In the embodiments illustrated in FIG. 8 and FIG. 9 there are indicated examples of providing heat exchangers, and according to the invention heat exchangers may be provided as one body which can cover the total area of air inlet port 11*a* and outlet port 11*b* formed of the outer circuit of housing 30 or heat exchangers are separately provided.

Also, in an embodiment of the invention, the heat exchangers can be of the electric heating type.

In the radiator thus constructed, hot water is circulated between heat exchangers 5*a* and 5*b*, motor 1' is put into action in order to drive sirocco fan 10, air is sucked by way of air inlet port 11*a* of housing 20 by means of air suction operation of sirocco fan 10, and suction air is, as shown by arrow 8*a*, induced into sirocco fan 10 from inducing frame 20 by way of inducing outlet 7 and discharged in the radial direction of fan 10 and housing 30. Discharged air is exhausted by way of outlet port 11*b* as shown by arrow 8*b*.

In the invention, air is heated first by heat changer 5*a* at the inlet port 11*a*, then it is again heated by heat changer 5*b* at outlet port 11*b*.

In general, pressure loss ΔP in an air flow flue can be calculated as follows.

$$\Delta P = f \cdot (l/de) \cdot (\gamma^{v}/2g)$$

in the formula:

f is coefficient of friction, l is the length of outflow flue, γ is specific volume of air, g is the acceleration of gravity, and v is air flowing velocity.

In this case pressure losses generated in the same form heat changers are proportionate to a square of l (length of outflow flue) and v (velocity of air flowing).

Therefore as in known constructions, when a fan convector provided with a radiator either at the intake side, or at the exhaust side is to maintain a fixed volume of radiant heat without enlarging the height and width of a covering and with a reduction in the depth (dimension) thereof, it is necessary either to maintaining the area of heat conductivity by enlarging or extending the length l of an outflow flue of a radiator since the air outflow area becomes small, or to increase the rate of heat change by accelerating the velocity v of air. As a result of this, in each of the systems pressure loss P is raised, so that the driving force of a ventilator must be larger, and a large-sized motor is needed. Acclerated velocity however will generate noises during operation.

Figure 6:
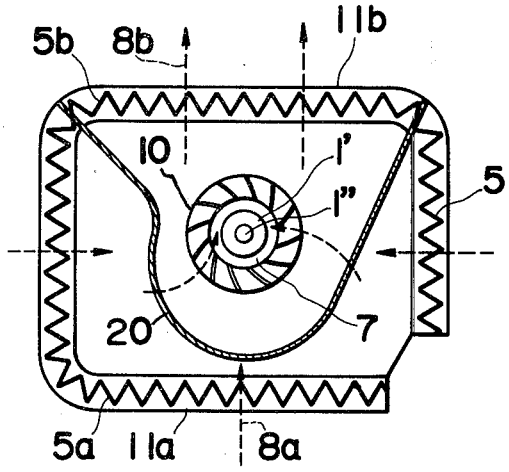
FIG. 6 is a front elevation of a longitudinal fan convector constructed in accordance with the invention.
Figure 10:
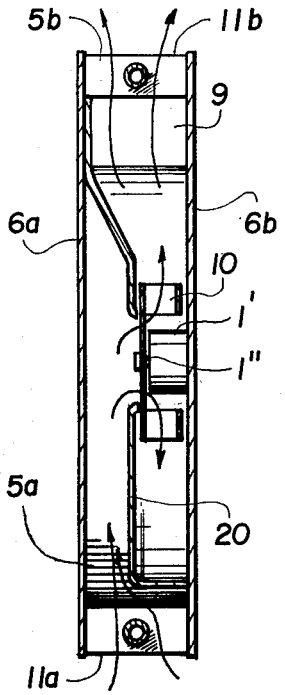
FIG. 10 is a right side sectional view of the invention as shown in FIG. 8.
Figure 11:
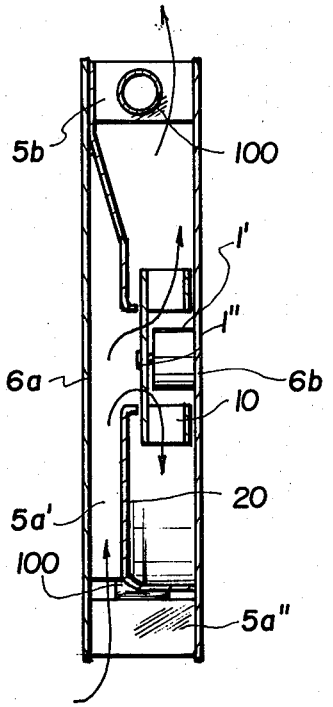
FIG. 11 is a right side sectional view of the embodiment of the invention shown in FIG. 9.

According to the invention there is provided a heat changer at the intake or inlet port 11*a* and at the exhaust to outlet port 11*b* within housing 30, so that the length of the outflow flue can be kept small and at the same time as shown in FIG. 6, at the intake side air flow area except that of discharging can be used as inlet port 11*a* and which is wider with a slower velocity of air than outlet port 11*b*. Accordingly, the total pressure losses of heat changer 5*a* and heat changer 5*b* provided at the inlet port 11*a* and at the outlet port 11*b*, respectively, can be reduced to a degree.

A sirocco fan with a smaller capacity, and motor with a less power are available, unlike the know constructions wherein there is provided a heat changer either at the intake side or at the exhaust side.

Next, when a fan convector whose height, width, depth (dimension) and volume of radiant heat is 500 mm, 600 mm, 50 mm and 1500 to 2000 Kcal, respectively. is used with one or two fin tube type radiators, pressure losses thereof are shown in FIG. 7 in accordance with the result of an experiment. In FIG. 7 a curve A shows pressure losses of heat exchangers provided at the intake and exhaust side while a curve B indicates pressure loss of a heat exchanger provided only at the exhaust side, by means of which the same volume of radiant heat is to be obtained. And a curve C illustrates pressure loss of a radiator whose depth (dimension) is more than 120 mm as shown in FIGS. 1–4.

The above description will make it clear that the invention which is provided with heat exchangers 5*a* and 5*b* is able to reduce pressure loss of a heat exchanger by lessening the height, width and especially the depth (dimension) to one half that of known construction.

In the invention, moreover, a sirocco fan for forcible ventilation is utilized whose axis of rotation 1'' is secured in the direction of the depth of housing 30, so that if the outside diameter of a blade is enlarged, it won't affect on the depth (dimension) of housing 30. The way in which the sirocco fan is secured according to the present invention, makes it possible to effectively utilize effectively the space within housing 30.

The volume of air moved by sirocco fan 10 is related to its rotational frequency, the width of its blades and the length thereof (outside diameter). A fixed volume of air and a fixed air pressure can be obtained by means of a blade with a larger outside diameter in the case of a shortened axial direction. As it may be easily seen, the invention makes use of the characteristic of a sirocco fan.

And in the invention there is provided motor 1' with an outer form of thin and depressed type positioned inside sirocco fan 10 whose axis of rotation is common to that of the former, so that the outer form of motor 1' will not affect the depth (dimension) of the radiator.

As mentioned above, the present invention makes it possible to use a smaller sized motor 1', obtain a necessary volume of radiant heat by the way that heat exchangers 5*a* and 5*b* are constituted, and make best use of a depressed fan in shape and a certain space within housing 30 owing to the characteristic of sirocco fan 10. Motor 1' constituted inside sirocco fan 10 will not affect the depth (dimension) of housing 30. As a result, it is possible to obtain a thinner housing. A saving of radiation or unit depth of one-half or one-third is thus possible.

As already mentioned, pressure loss with the invention is slight and so a sirocco fan and a motor with a smaller capacity or less power are available, and fewer noises are generated during operation. Heat changers 5*a* and 5*b* of a fan tube type are in contact directly with front covering 6*a* and rear covering 6*b* of covering 30, and if front covering 6*a* and rear covering 6*b* are made of a metallic plate, they can absorb heat, which may increase or promote heat efficiency due to radiant heat, and natural convection as well as radiant heat being available for heating during the daytime or sleeping time when the sirocco fan is stopped.

While specific embodiments of the invention have been shown and described in detail to illustrate the application of the principles of the invention, it will be understood that the invention may be embodied otherwise without departing from such principles.

What is claimed is:

1. A forced-air unit comprising a front cover member, a rear cover member connected to and spaced from said front cover member defining a unit housing having a depth between said cover members and a periphery, heat exchanger means extending along the substantial portion of said housing periphery, a sirocco fan rotatably mounted in said unit housing on an axis of rotation extending in the depth direction of said unit housing, said fan having a central inlet area and an annular outlet area for moving air radially outwardly of said annular outlet area and axially inwardly of said central inlet area when said fan rotates, a motor connected to said fan for rotating said fan to induce air axially into said inlet area and radially out through said outlet area, and a fan casing connected in said unit housing extending from said cover members and over said fan and having an inlet opening over said inlet area of said fan, said casing intersecting said heat exchanger means at two spaced locations thereof on said housing periphery, said fan casing defining with said front cover member an inlet space and said casing including an outlet area covering a portion of said housing periphery between said two spaced locations of said heat exchanger means defining an outlet port with said rear cover member, the remainder of said housing periphery comprising a housing inlet port for said inlet space whereby, with the rotation of said fan, a portion of air is caused to move radially inwardly of a portion of said heat exchange means through said inlet port and into said inlet space, around said fan casing in through said inlet opening of said fan casing and radially outwardly through said outlet port, said heat exchanger means disposed radially outwardly of said fan and substantially therearound and including at least one portion in said outlet port and at least one portion in said inlet port.

2. A forced-air unit according to claim 1, wherein said heat exchanger means comprises a single heat exchanger extending around said housing periphery with portions thereof in said inlet port and portions thereof in said outlet port.

3. A forced-air unit according to claim 1, wherein said heat exchanger means comprises a separate heat exchanger in said outlet portion and a separate heat exchanger in said inlet portion.

4. A forced-air unit according to claim 3, wherein said two mentioned heat exchangers are connected to each other through a connecting tube.

5. A forced-air unit according to claim 1, wherein said heat exchanger means is in thermal contact with said front and rear cover members whereby said front and rear cover members act as radiator bodies for said heat exchanger means.

6. A forced-air unit according to claim 1, wherein said heat exchanger means is in thermal contact with said front cover member.

7. A forced-air unit according to claim 1, wherein said heat exchanger means comprises a metallic tube having a plurality of fins extending therefrom, said tube adapted for receiving hot water.

8. A forced-air unit according to claim 1, wherein said unit housing is rectangular with said outlet port comprising one side of said rectangular unit housing and said inlet port comprising the remaining three sides of said rectangular unit housing.

9. A forced-air unit according to claim 1, wherein said motor means comprises a motor positioned within said central inlet area of said fan having an axle connected to said fan and aligned with the axis of said fan.

10. A forced-air unit according to claim 1, wherein said heat exchanger means comprises an electric heating member.

11. A forced-air unit according to claim 1, wherein said inlet port comprised of a portion of the periphery of said unit housing comprises two-thirds of the total periphery of said unit housing and said outlet port comprises the remaining one-third of said housing periphery.

* * * * *